US008036581B2

(12) United States Patent
Baek

(10) Patent No.: US 8,036,581 B2
(45) Date of Patent: Oct. 11, 2011

(54) DEVELOPING DEVICE TO SMOOTHY DISPENSE DEVELOPER AND IMAGE FORMING APPARATUS HAVING THE SAME

(75) Inventor: Chung Guk Baek, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 461 days.

(21) Appl. No.: 12/146,703

(22) Filed: Jun. 26, 2008

(65) Prior Publication Data

US 2009/0060593 A1 Mar. 5, 2009

(30) Foreign Application Priority Data

Sep. 5, 2007 (KR) ..... 10-2007-0089764

(51) Int. Cl.
*G03G 15/08* (2006.01)

(52) U.S. Cl. ..... 399/281

(58) Field of Classification Search ..... 399/281, 399/272

See application file for complete search history.

(56) References Cited

FOREIGN PATENT DOCUMENTS

| | | | |
|---|---|---|---|
| JP | 2002372861 A | * | 12/2002 |
| JP | 2003263024 A | * | 9/2003 |
| JP | 2008145798 A | * | 6/2008 |
| KR | 10-677576 | | 1/2007 |

OTHER PUBLICATIONS

Translation of JP2002-372861A; Dec. 2002.*

* cited by examiner

*Primary Examiner* — Quana M Grainger
(74) *Attorney, Agent, or Firm* — Stanzione & Kim, LLP

(57) ABSTRACT

A developing device capable of smoothly dispersing a developer in a development container and an image forming apparatus having the developing device. The developing device includes a development container which contains a developer and has an opening, a development roller which is mounted near the opening of the development container, a conveying member which is movably mounted in the development container to supply the developer to the development roller and moves forward and backward in a direction of the opening, and at least one dispersing member which operates according to the forward/backward movement of the conveying member to disperse the developer in the development container.

21 Claims, 9 Drawing Sheets

DEVELOPING DEVICE TO SMOOTHY DISPENSE DEVELOPER AND IMAGE FORMING APPARATUS HAVING THE SAME

CROSS-REFERENCE TO RELATED APPLICATIONS

This application claims priority under 35 U.S.C 119(a) from Korean Patent Application No. 2007-0089764, filed on Sep. 5, 2007 in the Korean Intellectual Property Office, the disclosure of which is incorporated herein in its entirety by reference.

BACKGROUND OF THE INVENTION

1. Field of the Invention

The present general inventive concept relates to a developing device of an image forming apparatus, and more particularly, to a developing device capable of smoothly dispersing a developer in a development container and an image forming apparatus having the above developing device.

2. Description of the Related Art

Korean Patent Registration No. 10-677576 (issued on Feb. 2, 2007) discloses an image forming apparatus having a plurality of developing devices which develop an electrostatic latent image on a photosensitive body into a visible image by supplying developers to the photosensitive body. In order to form a color image, the plurality of developing devices contain developers of respectively different colors.

Each of the developing devices is provided with a development container to contain a developer, a development roller rotatably mounted near an opening of the development container to supply the developer to the photosensitive body, and a conveying means to supply the developer in the development container to the development roller. According to a recent trend toward compactness of the image forming apparatus, the developing device is designed to be decreased in thickness and size.

However, the aforementioned conventional developing device has a problem such that the developer in the developing device may gather to one side and form a lump by being shaken or tilted during conveyance of the developing device. Especially, in a case where the development container is small, such a problem occurs more severely. At this time, the developer is not smoothly supplied to the development roller, or the lumped developer binds the conveying means in the development container. Accordingly, the developing device is operated unstably, and noise is generated.

SUMMARY OF THE INVENTION

The present general inventive concept provides a developing device capable of smoothly dispersing a developer in a development container.

The present general inventive concept also provides an image forming apparatus having the above developing device.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a developing device including a development container to contain a developer, the development container having an opening; a development roller mounted near the opening of the development container, a conveying member movably mounted in the development container to supply the developer to the development roller, the conveying member moving forward and backward in a direction of the opening, and at least one dispersing member operating with the forward/backward movement of the conveying member to disperse the developer in the development container.

The conveying member may include a pressing part in contact with the dispersing member, and the dispersing member may include a fixing portion fixed in the development container, and a dispersing portion extending from the fixing portion by a predetermined length. The dispersing portion may be elastically deformed to pivot at a predetermined angle by operation of the pressing part.

The developing device may further include an operating shaft rotatably mounted in the development container, the operating shaft having an eccentric portion in contact with the conveying member to cause the forward/backward movement of the conveying member; and at least one return spring mounted in the development container to return the conveying member.

The pressing part of the conveying member may have a first end in contact with the dispersing member, and a second end in contact with the eccentric portion of the operating shaft.

The developing device may further include a plurality of gears coupled to a shaft of the development roller and the operating shaft to transmit a rotational force from the shaft of the development roller to the operating shaft.

The conveying member may have a flat plate shape, and may be formed with a guide slot extending lengthwise in a direction crossing the forward/backward moving direction of the conveying member to guide the operation of the dispersing member. The dispersing member may include a fixing portion fixed in the development container, a dispersing portion extending from the fixing portion by a predetermined length so as to be elastically deformed, and a protruding portion protruding from the dispersing portion to be fitted into the guide slot. When the conveying member moves forward and backward, the dispersing portion may pivot.

The dispersing member may include a first dispersing member and a second dispersing member respectively mounted near both side ends in the development container.

The foregoing and/or other aspects and utilities of the present general inventive concept may also be achieved by providing an image forming apparatus including a main body, a photosensitive body mounted in the main body, and a developing device to supply a developer to the photosensitive body, the developing device including a development container to contain a developer, the development container having an opening, a development roller mounted near the opening of the development container; a conveying member movably mounted in the development container to supply the developer to the development roller, the conveying member moving forward and backward in a direction of the opening, and at least one dispersing member operating with the forward/backward movement of the conveying member to disperse the developer in the development container.

The foregoing and/or other aspects and utilities of the present general inventive concept may also be achieved by providing a developing device, including a development container to contain developer, a development roller to transfer the developer from the development container to a printing medium, a conveying member to convey the developer to the development roller, and at least one dispersing member to elastically deform and disperse the developer in the development container based on a movement of the conveying member.

The developing device may further include an operating shaft to control the movement of the conveying member according to a rotation of a shaft of the development roller.

The operating shaft may include at least one eccentric portion to contact a portion of the conveying member to push the conveying member away from the development roller based on the rotation of the operating shaft.

The conveying member may include at least one pressing part to contact a portion of the operating shaft to guide the movement of the conveying member based on the rotation of the operating shaft.

The at least one pressing part may press against a portion of the at least one dispersing member to deform the at least one dispersing member in order to disperse the developer in the development container.

The developing device may further include a cover to enclose the conveying member within the development container, and a return spring connected at one end to the cover and at another end to the conveying member to provide an elastic force to return the conveying member.

The conveying member may include at least one guide slot corresponding to the at least one dispersing member to control the elastic deformation of the dispersing member based on the movement of the conveying member.

The at least one dispersing member may include a protruding portion to insert within the guide slot to direct the elastic deformation of the at least one dispersing member during the movement of the conveying member.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
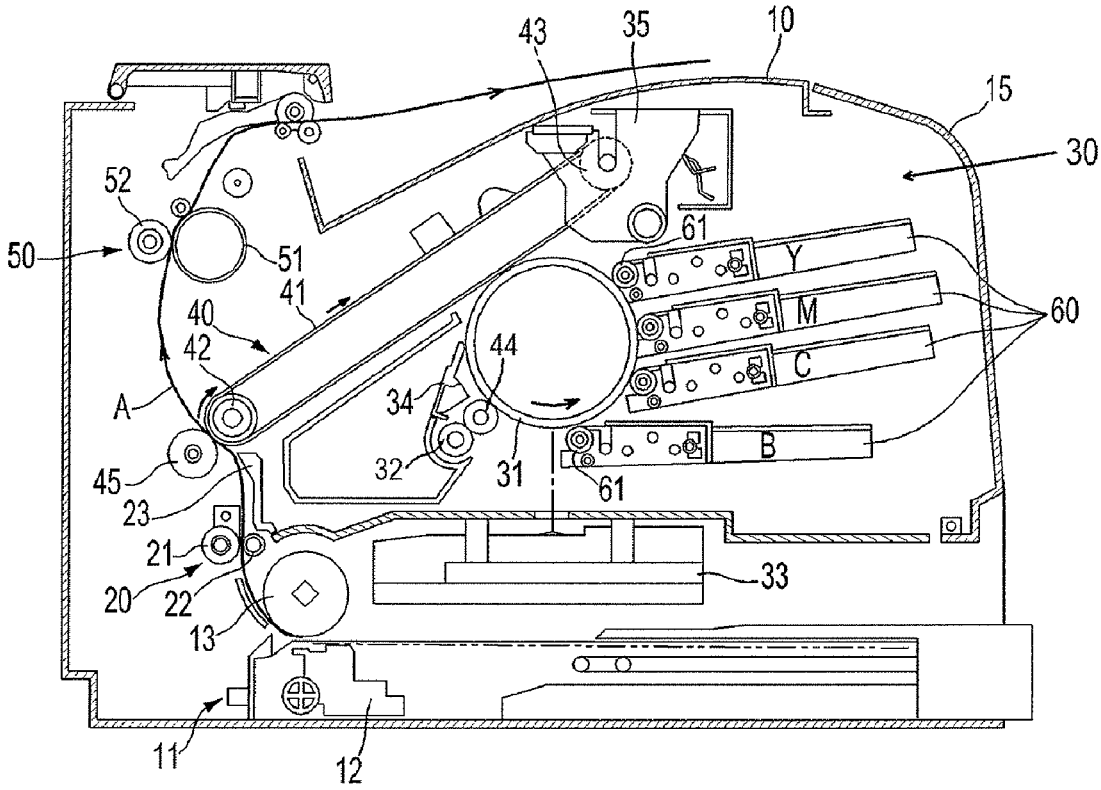
FIG. 1 is a sectional view illustrating a constitution of an image forming apparatus according to an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 illustrated a schematic constitution of a color image forming apparatus applied with a developing device according to an embodiment of the present general inventive concept. An image forming apparatus includes a paper supply unit 11 to accommodate paper, a feeding unit 20 to feed the paper, an image forming unit 30 to form an image on the paper, and a fusing unit 50 to fuse the transferred image to the paper.

The paper supply unit 11 is mounted in a lower portion of a main body 10. The paper supply unit 11 includes a cassette-type paper tray 12, a paper pressing device (not illustrated) to press the paper in the paper tray 12 to a pickup roller 13 provided above the paper tray 12. The pickup roller 13 picks up the paper sheet by sheet by rotation, and supplies the paper to the feeding unit 20.

The feeding unit 20 feeds the paper picked up by the pickup roller 13 to a print path A. The feeding unit 20 includes a feeding roller 21, a feeding backup roller 22, and a feeding guide 23 which forms the print path A.

The image forming unit 30 includes a drum-shaped photosensitive body 31, a charge roller 32 to charge the photosensitive body 31, a laser scanning unit (LSU) 33 to irradiate a laser beam to the charged photosensitive body 31 according to an image signal to form an electrostatic latent image on the surface of the photosensitive body 31, and a plurality of developing devices 60 to supply developers to the electrostatic latent image formed on the photosensitive body 31 to form a visible image. The plurality of developing devices 60 contain the developers of yellow (Y), magenta (M), cyan (C) and black (B), respectively, to print a color image. Each of the developing devices 60 has a development roller 61 which is mounted adjacent to the outer surface of the photosensitive body 31 so as to supply the developer to the photosensitive body 31. The photosensitive body 31 charged by the charge roller 32 has a negative charge, and an electrostatic latent image is formed on the surface of the photosensitive body 31 by the laser beam irradiated from the LSU 33. Each of the developing devices 60 adheres the respective developer having a negative charge to the electrostatic latent image on the photosensitive body 31 to form a visible image. A detailed description of each of the developing devices 60 will be explained later.

The image forming unit 30 further includes a transfer device 40 to transfer the image formed on the photosensitive body 31 to the paper. The transfer device 40 includes an intermediate transfer belt 41 provided in contact with the outer surface of the photosensitive body 31, a first supporting roller 42 and a second supporting roller 43 to support the intermediate transfer belt 41, a first transfer roller 44 and a second transfer roller 45. The first transfer roller 44 is mounted adjacent to the photosensitive body 31. Power is applied to the first transfer roller 44 so that the image developed on the photosensitive body 31 can be transferred onto the intermediate transfer belt 41. The second transfer roller 45 is mounted adjacent to the first supporting roller 42. Power is applied to the second transfer roller 45 so that the image transferred onto the intermediate transfer belt 41 can be transferred onto the paper. The image forming apparatus further includes a first cleaning device 34 to remove residual developer from the photosensitive body 31 after the image is transferred onto the intermediate transfer belt 41 from the photosensitive body 31, and a second cleaning device 35 to remove the residual developer on the intermediate transfer belt 41 after the image is transferred onto the paper from the intermediate transfer belt 41.

A color image forming principle of the image forming unit 30 will now be explained. For example, if the LSU 33 irradiates light corresponding to yellow image information to the photosensitive body 31 charged by the charge roller 32, an electrostatic latent image corresponding to the yellow image is formed on the photosensitive body 31. Then, a yellow developer is adhered to the electrostatic latent image by the yellow developing device 60, and the electrostatic latent image is developed into a yellow image on the photosensitive body 31. The yellow image is transferred onto the intermediate transfer belt 41 by the first transfer roller 44. After the yellow image corresponding to one page is completely transferred onto the intermediate transfer belt 41, the images of magenta, cyan and black are sequentially transferred onto the intermediate transfer belt 41 through the same procedures as above. Accordingly, a color image is formed on the intermediate transfer belt 41 by the images of yellow, magenta, cyan and black being overlapped. Thereafter, the color image is transferred onto the paper passing between the intermediate transfer belt 41 and the second transfer roller 45.

The fusing unit 50 includes a heating roller 51 and a pressing roller 52, which are provided near an outlet of the print path A. The fusing unit 50 fuses the image to the paper by applying heat and pressure to the image transferred onto the paper while the paper passes between the heating roller 51 and the pressing roller 52.

The developing devices 60 to supply the developers to the photosensitive body 31 are removably mounted in the main body 10 in such a manner that the developing devices 60 are guided along rails (not illustrated) provided in the main body 10. The developing devices 60 can be removed from the main body 10 by opening a cover 15 provided at a front surface of the main body 10. Since the developing devices 60 have substantially the same constitution and operation with the exception of the kind of the developer contained therein, only one developing device will be described hereinafter.

Figure 2:
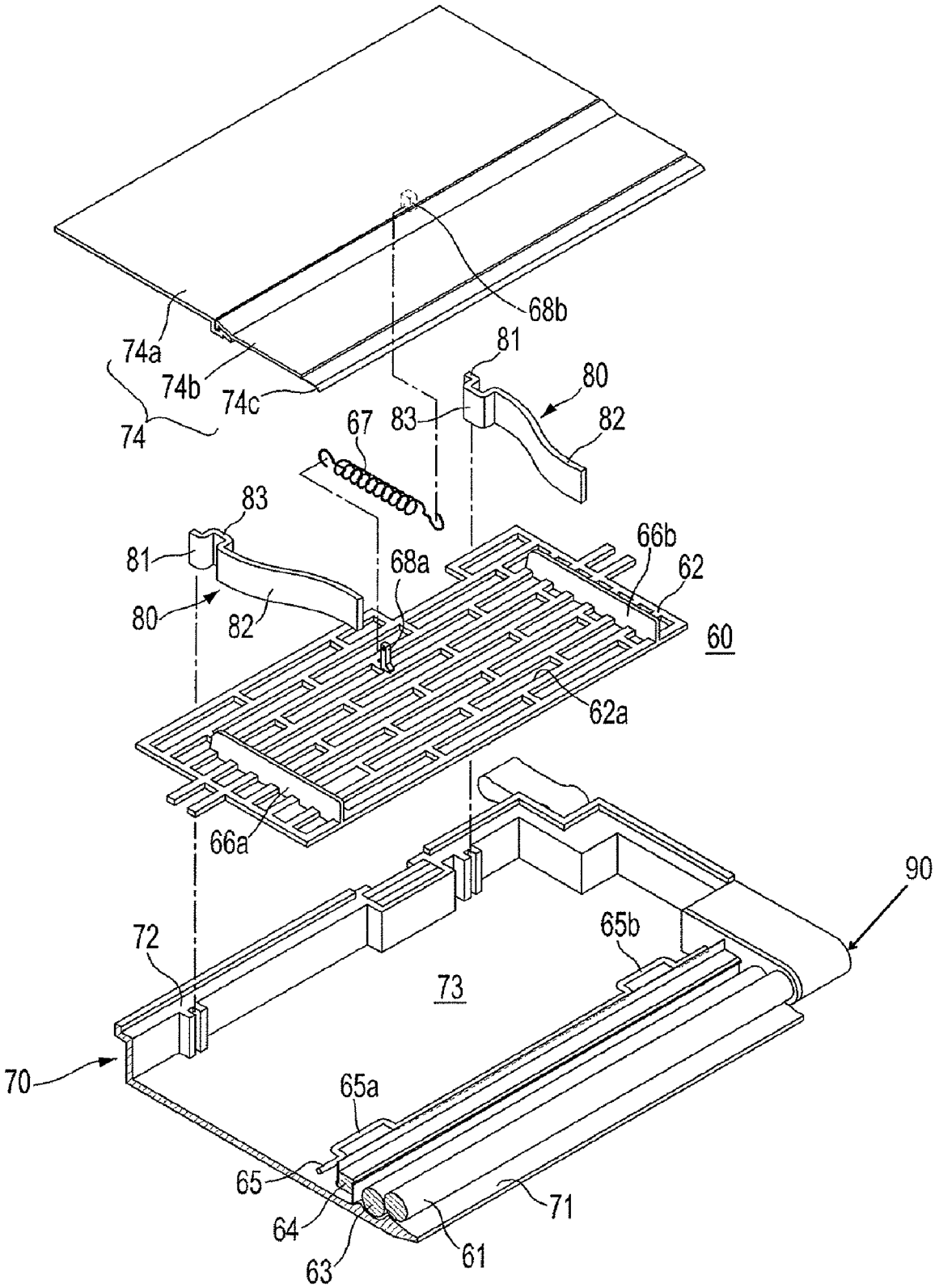
FIG. 2 is an exploded perspective view of a developing device according to an embodiment of the present general inventive concept.
Figure 3:
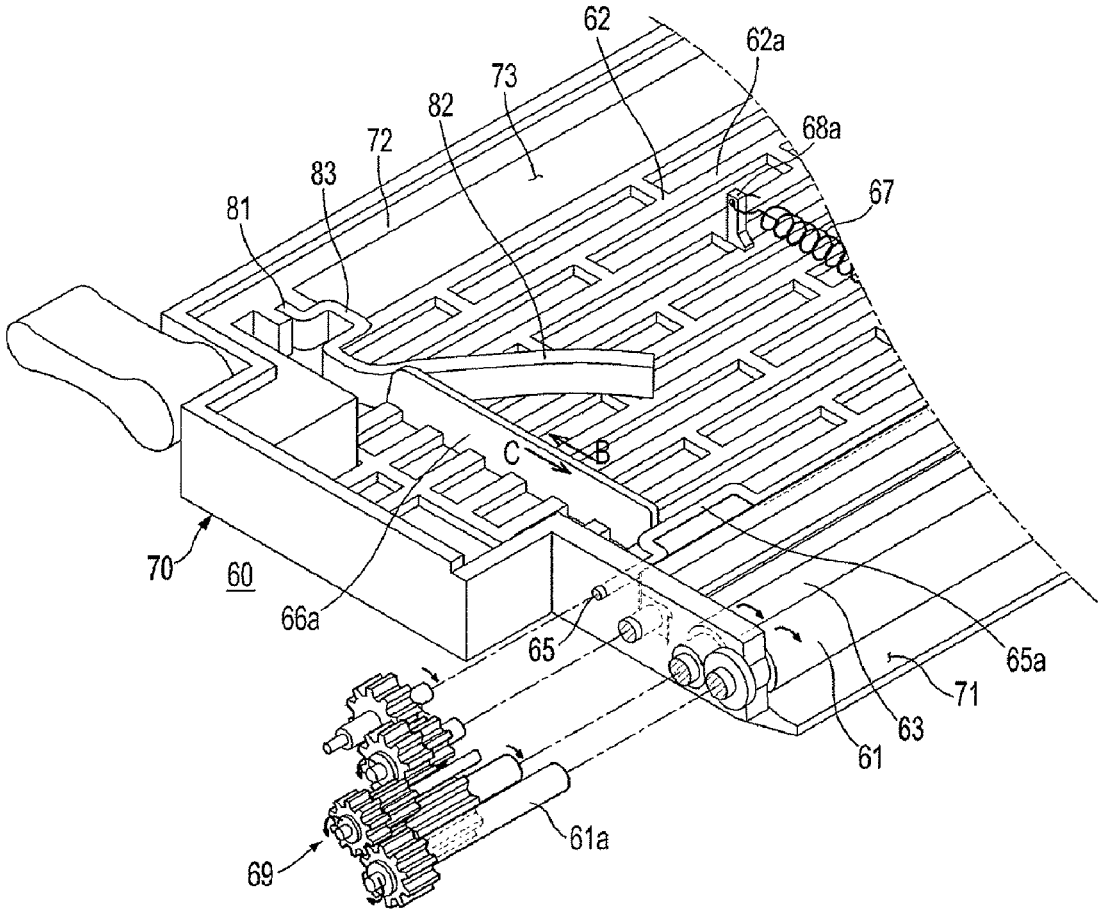
FIG. 3 is a perspective view illustrating a dispersing member of the developing device according to an embodiment of the present general inventive concept.
Figure 4:
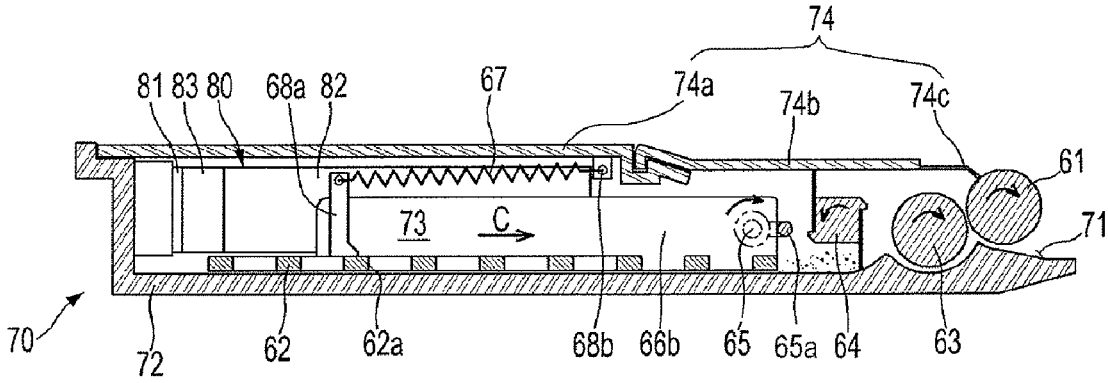
FIGS. 4 and 5 are sectional views of the developing device according to an embodiment of the present general inventive concept, which illustrate an operating state of a conveying member.

As illustrated in FIGS. 2 to 4, the developing device 60 includes a development container 70 to contain a container, a development roller 61 mounted adjacent to an opening 71 of the development container 70, and a conveying unit 90 to convey the developer in the development container 70 to the development roller 61.

The development container 70 includes a lower case 72 which is formed in a rectangular box shape having an opened top, and a cover 74 which covers the opened top of the lower case 72. The lower case 72 and the cover 74 define a space 73 to contain the developer. As illustrated in FIG. 4, the cover 74 includes a first covering portion 74*a* which covers the top of the lower case 72 above the developer containing space 73, a second covering portion 74*b* which covers the top of the lower case 72 above the opening 71, and a regulation blade 74*c* which extends from a front end of the second covering portion 74*b* toward an outer surface of the development roller 61. The regulation blade 74*c* regulates a thickness of the developer adhered to the outer surface of the development roller 61, which is to be supplied to the photosensitive body 31.

The conveying unit 90 includes a flat plate-shaped conveying member 62 which is mounted movably forward and backward in the developer containing space 73, a conveying roller 63 which is rotatably mounted adjacent to the development roller 61, and a conveying blade 64 which is rotatably mounted between the conveying roller 63 and the conveying member 62.

The conveying member 62 is formed with a plurality of through-holes 62*a* in a lattice pattern, through which the developer can pass. The conveying member 62 moves forward and backward within a predetermined region in the direction of the opening 71 of the development container 70, so as to convey the developer in the developer containing space 73 toward the development roller 61. An operating shaft 65 is rotatably mounted between the conveying member 62 and the conveying blade 64, which has eccentric portions 65*a* and 65*b* formed respectively near both ends of the operating shaft 65. Pressing parts 66*a* and 66*b* are provided on an upper surface of the conveying member 62, respectively near both side ends of the conveying member 62. The pressing parts 66*a* and 66*b* protrude upward from the upper surface of the conveying member 62, and have a long length in the direction of forward/backward movement of the conveying member 62. A return spring 67 is mounted on the conveying member 62 in such a manner that a first end of the return spring 67 is fixed to a first spring fixing part 68*a* of the conveying member 62 and a second end of the return spring 67 is fixed to a second spring fixing part 68*b* of the first covering portion 74*a* of the cover 74. When the operating shaft 65 rotates, the eccentric portions 65*a* and 65*b* of the operating shaft 65 push the pressing parts 66*a* and 66*b* of the conveying member 62 in a first direction (B) (refer to FIG. 5). If the pressing force of the eccentric portions 65*a* and 65*b* on the pressing parts 66*a* and 66*b* is removed, the conveying member 62 can move in a second direction (C), which is opposite to the first direction (B), by the elasticity of the return spring 67 (refer to FIG. 4). In other words, by the eccentric rotation of the eccentric portions 66*a* and 66*b* of the operating shaft 65, the conveying member 62 moves forward and backward in the direction of the opening 71, and accordingly the developer in the developer containing space 73 is conveyed toward the development roller 61.

Figure 5:
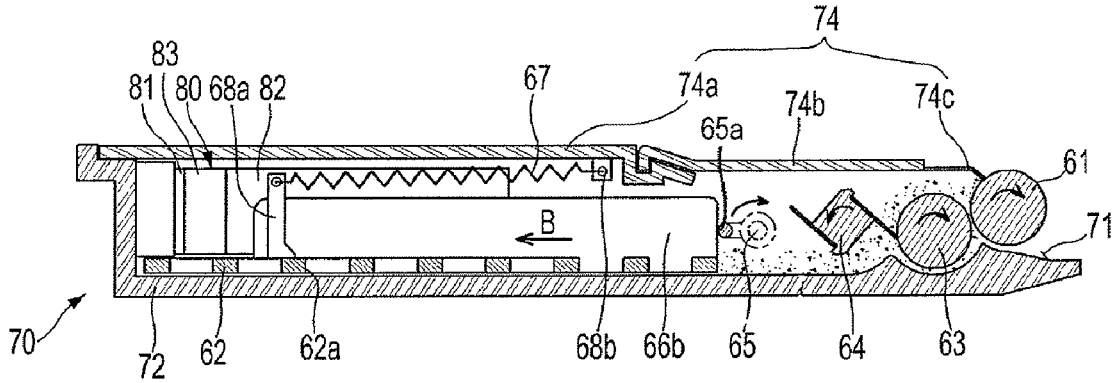

As illustrated in FIGS. 3 to 5, the conveying blade 64 and the conveying roller 63 supply the developer, which is conveyed by the forward/backward movement of the conveying member 62, to the development roller 61 by the rotation. When the developing device 60 is installed into the main body 10, the development roller 61 is connected with a driving source (not illustrated) provided in the main body 10, so as to be rotated. A rotational force transmitted to a shaft 61 a of the development roller 61 can be transmitted to the conveying roller 63, the conveying blade 64 and the operating shaft 65 through a plurality of gears 69 engaged with each other as illustrated in FIG. 3. Accordingly, when the development roller 61 rotates, the conveying roller 63, the conveying blade 64 and the operating shaft 65 rotate, and the conveying member 62 moves forward and backward by the operation of the operating shaft 65. As a result, the developer in the development container 70 can be supplied to the development roller 61.

As illustrated in FIGS. 2 and 3, dispersing members 80 are mounted in the development container 70, near both the side ends of the development container 70, respectively. The dispersing members 80 are operated by the forward/backward movement of the conveying member 62 to disperse the developer in the development container 70. Each of the dispersing members 80 includes a fixing portion 81 which is fixed to an inner rear portion of the development container 70, a dispersing portion 82 which extends lengthwise from the fixing portion 81 toward the development roller 61 and is elastically deformable, and a curved portion 83 which connects the fixing portion 81 and the dispersing portion 82 to secure the smooth deformation of the dispersing portion 82. Such a dispersing member 80 has a vertical width smaller than a vertical height of the developer containing space 73, and may be made of a metallic plate material or a resin material, which has elasticity.

Figure 6:
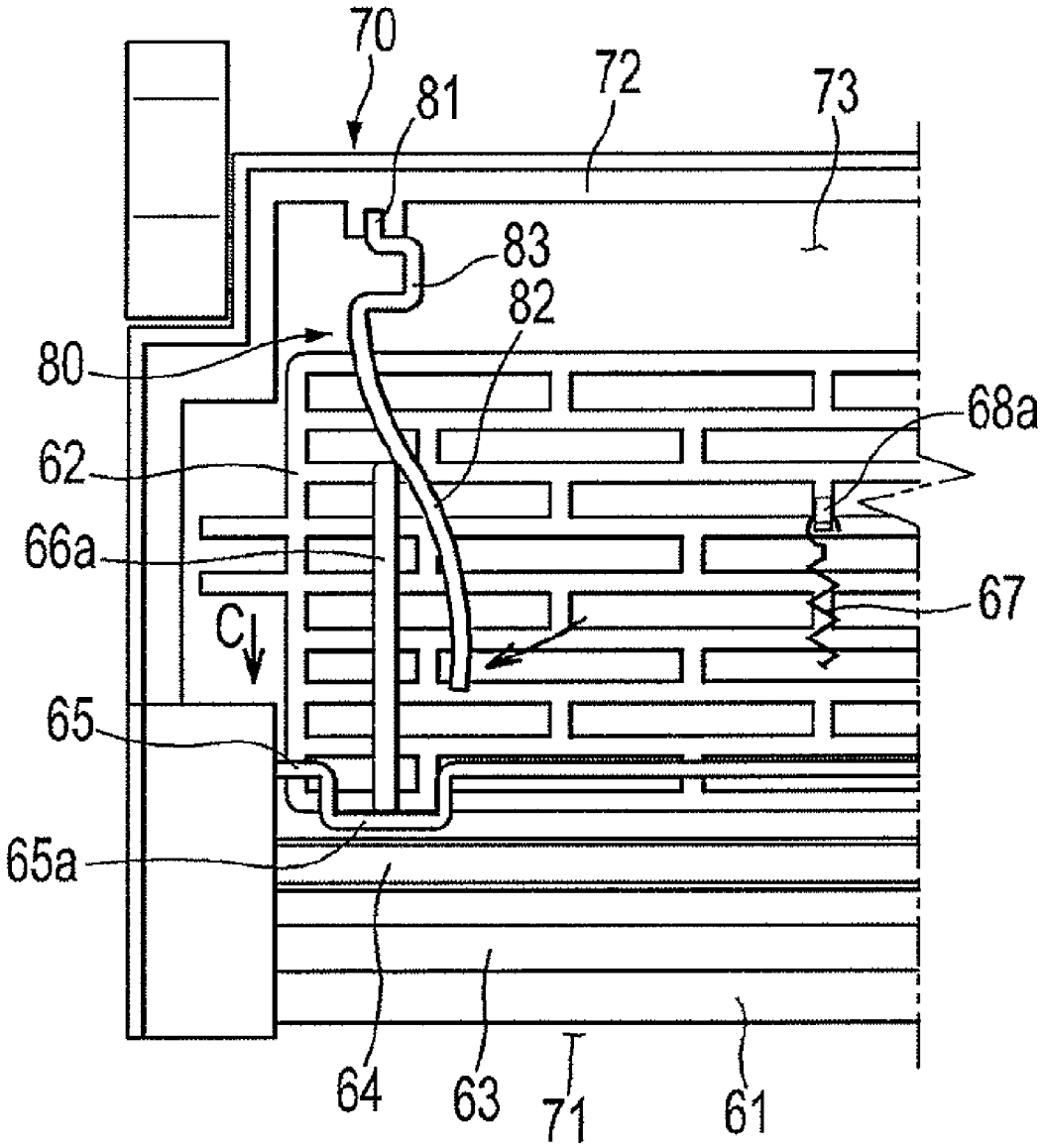
FIGS. 6 and 7 are plan views of an inner constitution of the developing device according to an embodiment of the present general inventive concept, which illustrate an operating state of the dispersing member.
Figure 7:
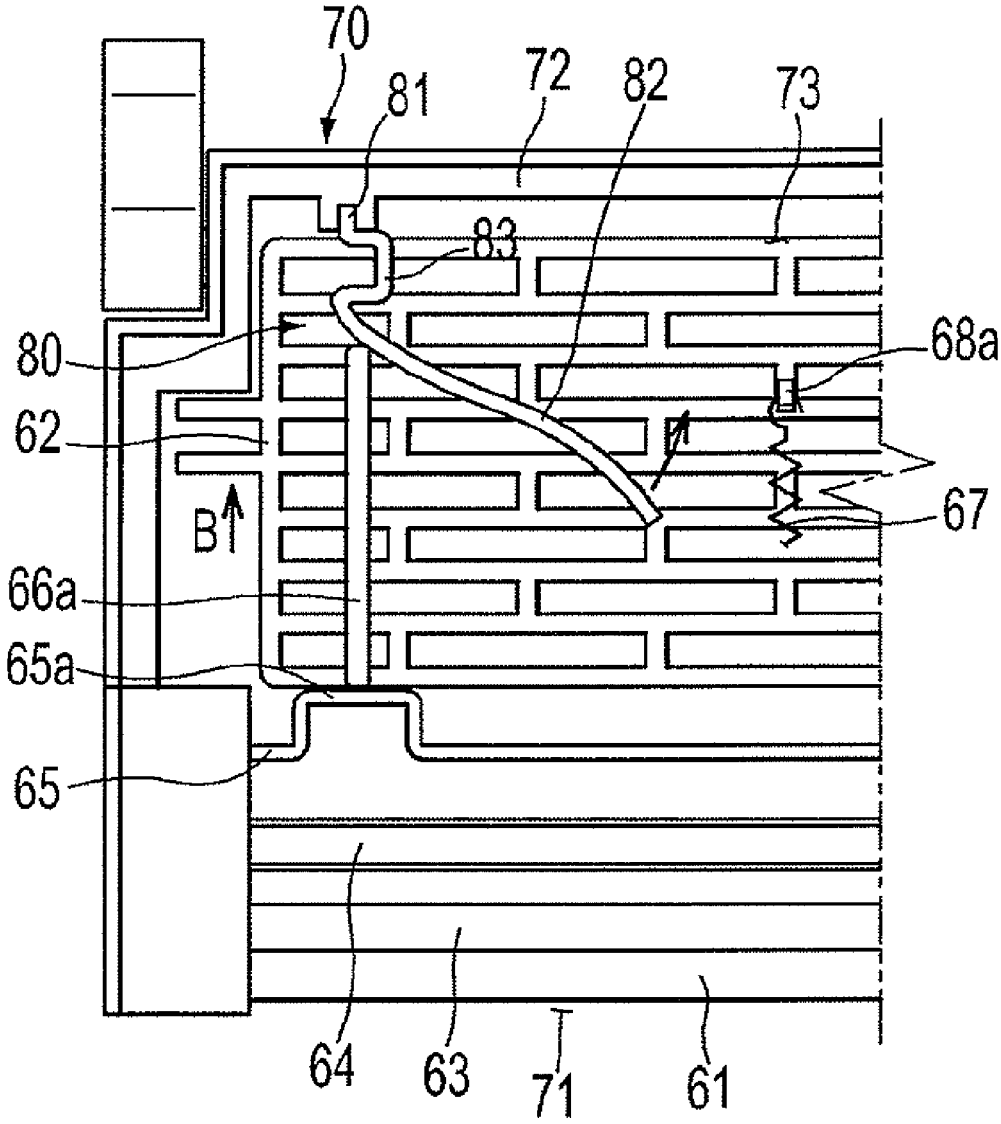

As illustrated in FIGS. 3 and 6, each of the dispersing members 80 is kept in a state such that one side surface of the dispersing portion 82 is in contact with a rear end of each of the pressing parts 66*a* and 66*b* of the conveying member 62. Therefore, as illustrated in FIGS. 6 and 7, when the conveying member 62 moves forward and backward, the dispersing portions 82 of the dispersing members 80 are pushed by the pressing parts 66*a* and 66*b* or are released from the pushing force of the pressing parts 66*a* and 66*b*. Accordingly, free ends of the dispersing portions 82 are elastically deformed in the manner of pivoting on the fixing portions 81. As illustrated in FIG. 6, when the conveying member 62 moves forward (toward the opening 71), the pushing force of the pressing parts 66*a* and 66*b* on the dispersing portions 82 is removed, and thus the dispersing members 80 are restored to their own original states. As illustrated in FIG. 7, when the conveying member 62 moves backward, the dispersing portions 82 are pushed by the pressing parts 66*a* and 66*b*, and thus are elastically deformed to be bent. Such an operation of the dispersing members 80 is carried out repeatedly by the forward/backward movement of the conveying member 62. Accordingly, the developer contained near both the side ends of the developer containing space 73 is dispersed by the operation of the dispersing members 80, thereby preventing the developer from forming a lump in the development container 70. Furthermore, even if the developer in the development container 70 forms a lump during conveyance of the developing device 60 or the image forming apparatus equipped with the developing device, the developer can be dispersed by the dispersing members 80. Thereby, the smooth operation of the conveying member 62 and the smooth supply of the developer can be achieved.

Figure 8:
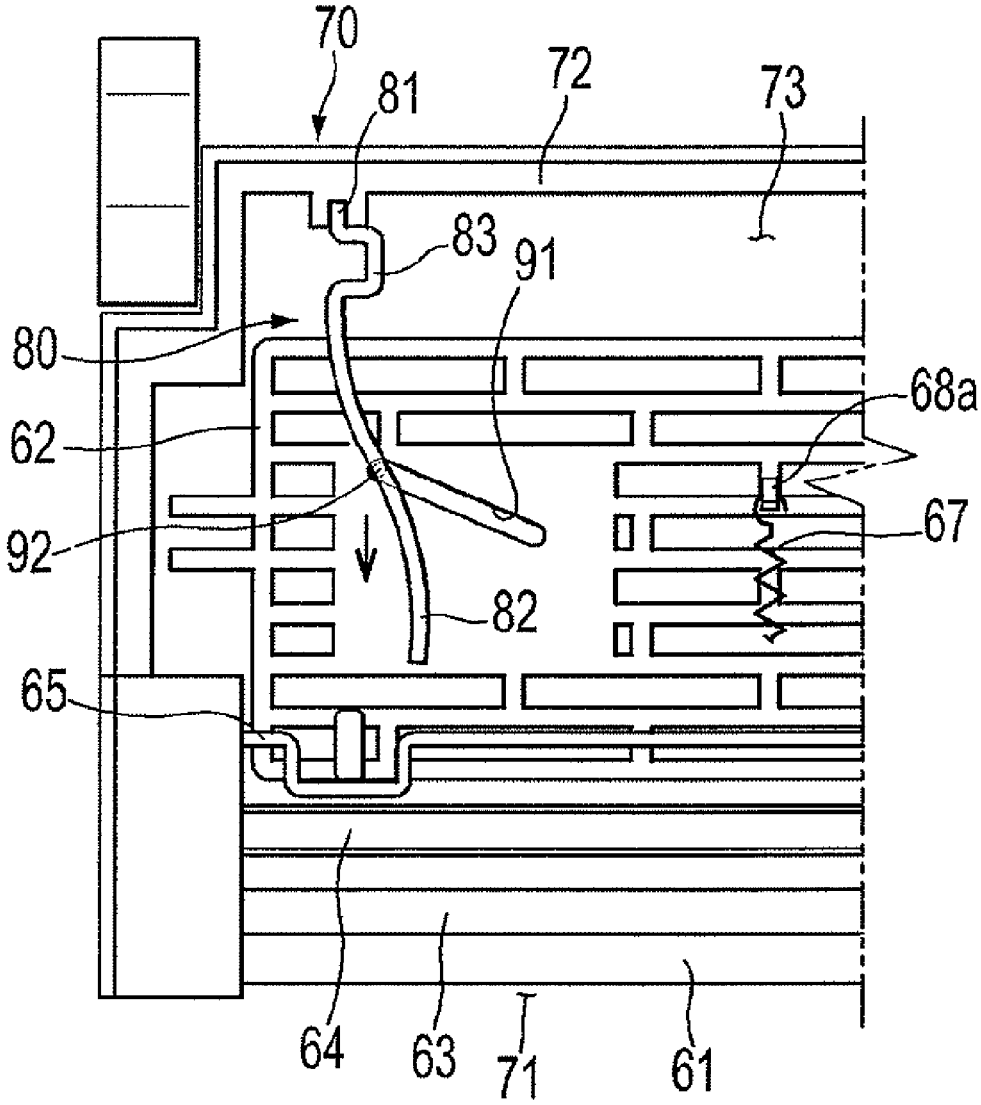
FIGS. 8 and 9 are plan views of an inner constitution of a developing device according to another embodiment of the present general inventive concept, which illustrate an operating state of a dispersing member.
Figure 9:
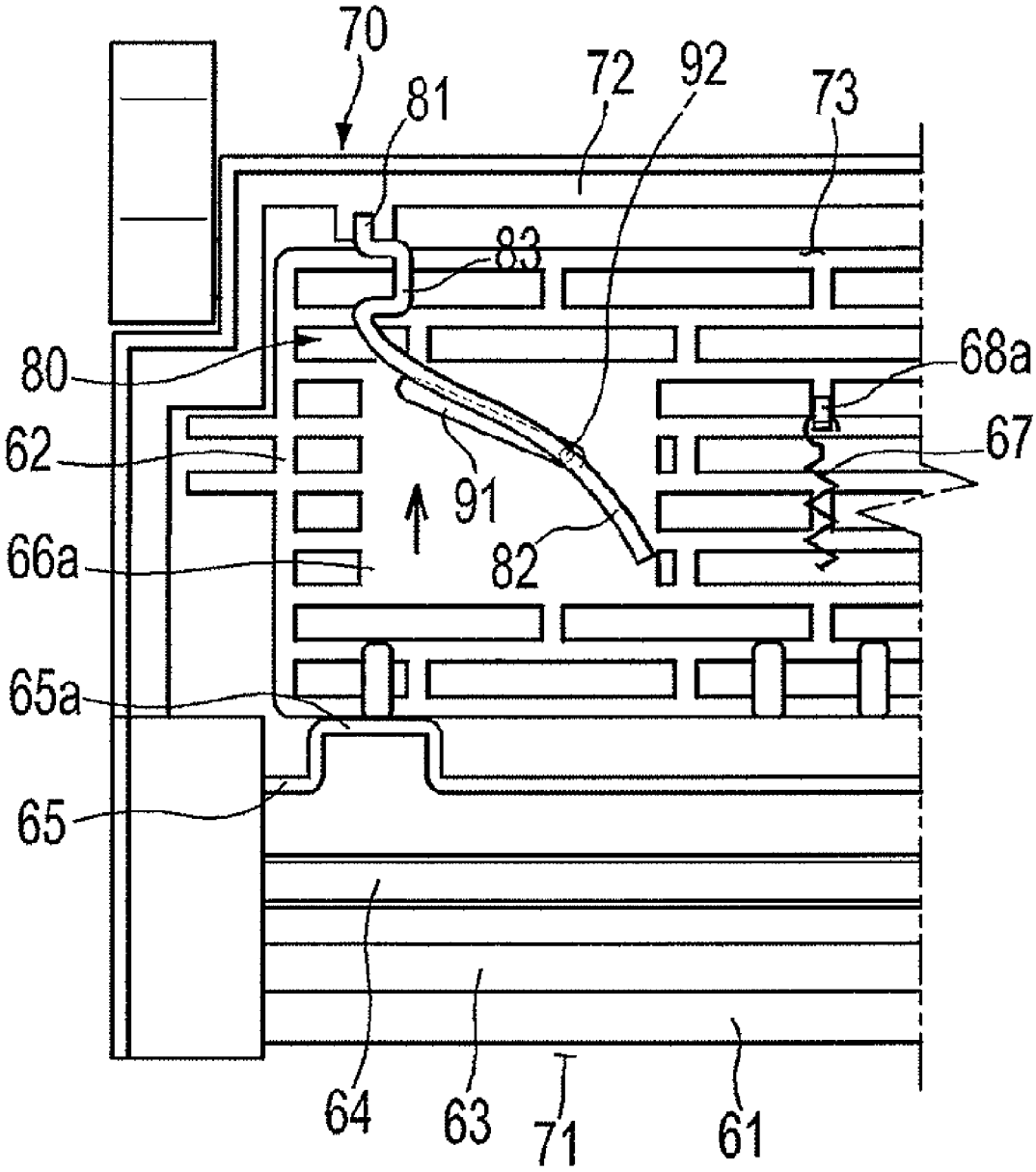

FIGS. 8 and 9 illustrate a developing device according to another embodiment of the present general inventive concept. The conveying member 62 is formed with guide slots 91 to cause the operation of the dispersing members 80, and the dispersing members 80 are provided with protruding portions 92 which protrude from the dispersing portions 82 to be fitted into the guide slots 91. Other elements of the developing device of this embodiment are substantially the same as those of the developing device of the above-described previous embodiment. The same elements as the previous embodiment are denoted by the same reference numerals.

As illustrated in FIGS. 8 and 9, when the conveying member 62 moves forward and backward, the dispersing members 80 are operated by the protruding portions 92 provided at the dispersing portions 82 being guided along the guide slots 91 provided at the conveying member 62. The guide slots 91 extend lengthwise in the direction of crossing the forward/backward moving direction of the conveying member 62. In order to secure the smooth bending deformation of the dispersing members 80, the guide slots 91 may be inclined to a certain extent with respect to the direction perpendicular to the forward/backward moving direction of the conveying member 62.

As apparent from the above description, a developing device according to the present general inventive concept can prevent developer from forming lumps therein and can smoothly disperse the developer, because the dispersing members disperse the developer in the development container by operating with a forward/backward movement of a conveying member.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A developing device, comprising:

a development container to contain a developer, the development container having an opening;

a development roller mounted near the opening of the development container;

a conveying member movably mounted in the development container to supply the developer to the development roller, the conveying member moving forward and backward in a direction of the opening; and at least one dispersing member to operate according to the forward/backward movement of the conveying member to disperse the developer in the development container.

2. The developing device according to claim 1, wherein:

the conveying member includes a pressing part in contact with the dispersing member; and the dispersing member includes a fixing portion fixed in the development container and a dispersing portion extending from the fixing portion by a predetermined length, whereby the dispersing portion is elastically deformed to pivot at a predetermined angle by operation of the pressing part.

3. The developing device according to claim 2, further comprising:

an operating shaft rotatably mounted in the development container and having an eccentric portion in contact with the conveying member to cause the forward/backward movement of the conveying member; and at least one return spring mounted in the development container to return the conveying member.

4. The developing device according to claim 3, wherein the pressing part of the conveying member has a first end in contact with the dispersing member and a second end in contact with the eccentric portion of the operating shaft.

5. The developing device according to claim 3, further comprising:

plural gears coupled to a shaft of the development roller and the operating shaft to transmit a rotational force from the shaft of the development roller to the operating shaft.

6. The developing device according to claim 1, wherein:

the conveying member has a flat plate shape and is formed with a guide slot extending lengthwise in a direction crossing the forward/backward moving direction of the conveying member to guide the operation of the dispersing member; and the dispersing member includes a fixing portion fixed in the development container, a dispersing portion extending from the fixing portion by a predetermined length so as to be elastically deformed, and a protruding portion protruding from the dispersing portion to be fitted into the guide slot, whereby when the conveying member moves forward and backward, the dispersing portion pivots.

7. The developing device according to claim 1, wherein the dispersing member includes a first dispersing member and a second dispersing member respectively mounted near both side ends in the development container.

8. An image forming apparatus, comprising:

a main body;

a photosensitive body mounted in the main body; and a developing device to supply a developer to the photosensitive body, the developing device comprising:

a development container to contain a developer, the development container having an opening, a development roller mounted near the opening of the development container, a conveying member movably mounted in the development container to supply the developer to the development roller, the conveying member moving forward and backward in a direction of the opening, and at least one dispersing member to operation according to the forward/backward movement of the conveying member to disperse the developer in the development container.

9. The image forming apparatus according to claim 8, wherein:

the conveying member includes a pressing part in contact with the dispersing member; and the dispersing member includes a fixing portion fixed in the development container and a dispersing portion extending from the fixing portion by a predetermined length, whereby the dispersing portion is elastically deformed to pivot at a predetermined angle by operation of the pressing part.

10. The image forming apparatus according to claim 9, wherein the developing device further includes:

an operating shaft rotatably mounted in the development container and having an eccentric portion in contact with the conveying member to cause the forward/backward movement of the conveying member; and at least one return spring mounted in the development container to return the conveying member.

11. The image forming apparatus according to claim 10, wherein the pressing part of the conveying member has a first end in contact with the dispersing member, and a second end in contact with the eccentric portion of the operating shaft.

12. The image forming apparatus according to claim 10, wherein the developing device further comprises:

a plurality of gears coupled to a shaft of the development roller and the operating shaft to transmit a rotational force from the shaft of the development roller to the operating shaft.

13. The image forming apparatus according to claim 8, wherein:

the conveying member has a flat plate shape, and is formed with a guide slot extending lengthwise in a direction crossing the forward/backward moving direction of the conveying member to guide the operation of the dispersing member; and the dispersing member includes a fixing portion fixed in the development container, a dispersing portion extending from the fixing portion by a predetermined length so as to be elastically deformed, and a protruding portion protruding from the dispersing portion to be fitted into the guide slot, whereby when the conveying member moves forward and backward, the dispersing portion pivots.

14. A developing device, comprising:

a development container to contain developer;

a development roller to transfer the developer from the development container to a printing medium;

a conveying member to convey the developer to the development roller; and at least one dispersing member to elastically deform and disperse the developer in the development container based on a movement of the conveying member.

15. The developing device of claim 14, further comprising:

an operating shaft to control the movement of the conveying member according to a rotation of a shaft of the development roller.

16. The developing device of claim 15, wherein the operating shaft comprises:

at least one eccentric portion to contact a portion of the conveying member to push the conveying member away from the development roller based on the rotation of the operating shaft.

17. The developing device of claim 15, wherein the conveying member comprises:

at least one pressing part to contact a portion of the operating shaft to guide the movement of the conveying member based on the rotation of the operating shaft.

18. The developing device of claim 17, wherein the at least one pressing part presses against a portion of the at least one dispersing member to deform the at least one dispersing member in order to disperse the developer in the development container.

19. The developing device of claim 14, further comprising:

a cover to enclose the conveying member within the development container; and a return spring connected at one end to the cover and at another end to the conveying member to provide an elastic force to return the conveying member.

20. The developing device of claim 14, wherein the conveying member comprises:

at least one guide slot corresponding to the at least one dispersing member to control the elastic deformation of the dispersing member based on the movement of the conveying member.

21. The developing device of claim 20, wherein the at least one dispersing member comprises:

a protruding portion to insert within the guide slot to direct the elastic deformation of the at least one dispersing member during the movement of the conveying member.

* * * * *